United States Patent [19]

Dehner

[11] 3,942,285

[45] Mar. 9, 1976

[54] MINIATURE TOY VEHICLE CONSTRUCTION

[75] Inventor: Bernard J. Dehner, Mound, Minn.

[73] Assignee: Tonka Corporation, Hopkins, Minn.

[22] Filed: Jan. 6, 1975

[21] Appl. No.: 538,756

[52] U.S. Cl. ..... 46/201; 46/221

[51] Int. Cl.[2] ..... A63H 17/05

[58] Field of Search ..... 46/201, 202, 221

[56] References Cited

UNITED STATES PATENTS 3,643,372 2/1972 Nash et al. ..... 46/201

3,668,806 6/1972 Pauly ..... 46/201

*Primary Examiner*—Louis G. Mancene
*Assistant Examiner*—Robert F. Cutting
*Attorney, Agent, or Firm*—Douglas L. Carlsen

[57] ABSTRACT

A miniature toy vehicle having an elongated body and two or more wheel and axle assemblies disposed on the underside of the body in longitudinally spaced positions with the axles disposed transversely of the body in parallelism and being seated in notches in the body, and a pan extending along the underside of the body between the wheels to hold the axles in said notches with the ends of the pan being secured to the body.

3 Claims, 5 Drawing Figures

FIG. 3
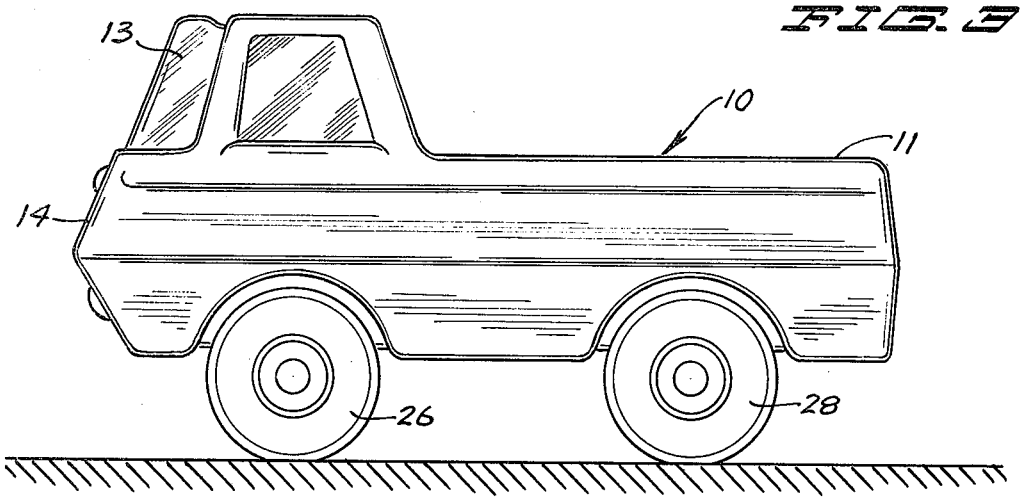
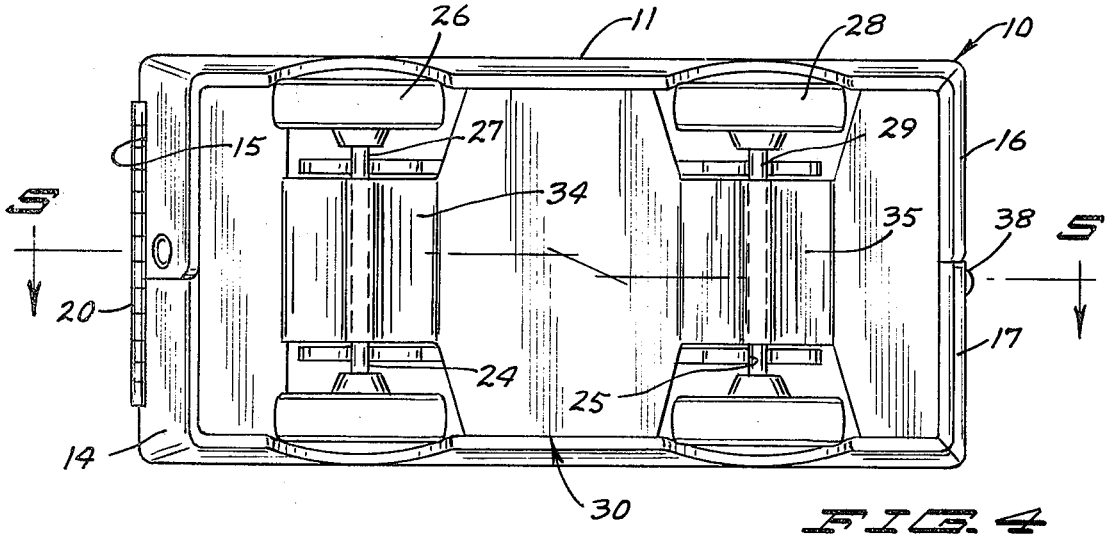
FIG. 4
FIG. 5
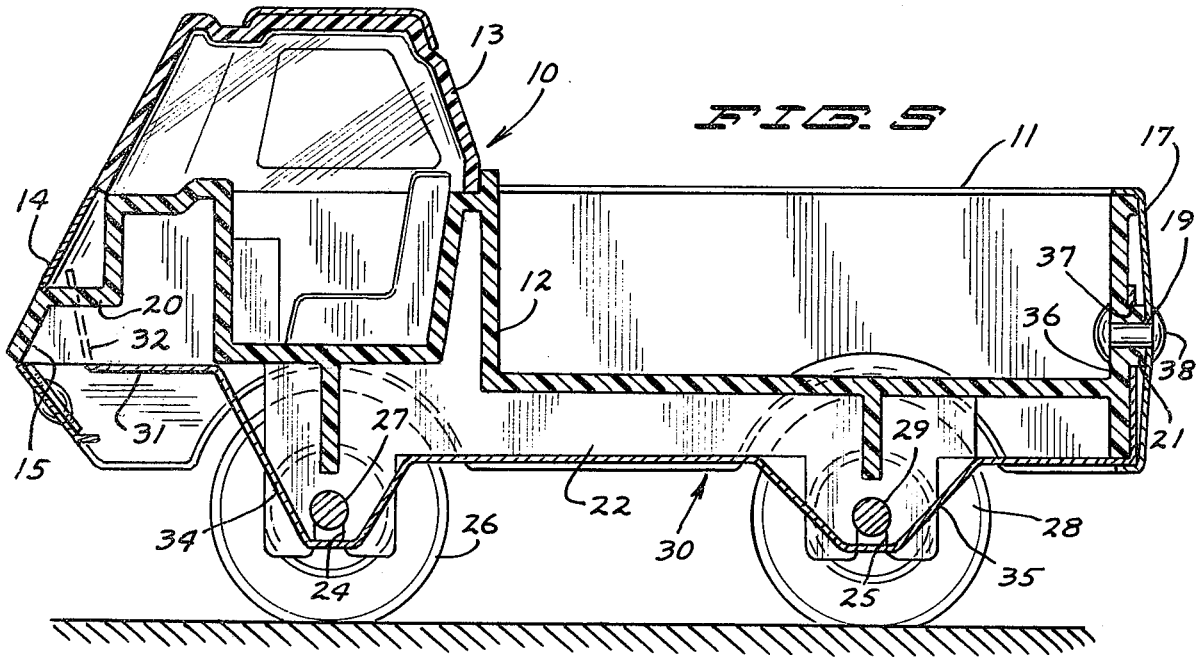

MINIATURE TOY VEHICLE CONSTRUCTION

This invention relates generally to the construction of miniature toy vehicles and particularly to a new and improved assembly for irremovably locking the wheels to the vehicle body.

Miniature toy vehicles commonly have a body provided with a plastic insert locked within a metal outer shell. The insert has downwardly opening slots into which the vehicle wheel axles can be snapped. While such a construction is operative it is possible for a child playing with the toy to remove the axle and wheels from the body by exerting downward pressure on one of the wheels.

Other forms of mounting the wheel and axle assemblies require either assembling the wheels on the axle after the axle has been mounted or the bending of metal tabs or the like over the notches into which the axles have first been seated.

A primary object of the present invention is to provide a wheel and axle mounting for miniature toy vehicles which allows quick and relatively inexpensive assembly and yet which securely retains the wheels and axles on the vehicle so that they cannot be removed by a small child to be lost, or even more seriously placed in the mouth or the like.

With this and other objects in view the invention broadly comprises forming a miniature toy vehicle body with a metal outer shell and a plastic insert having downwardly opening slots for receiving the vehicle wheel axles, the insert having projections at each end, a metal pan adapted to extend lengthwise under the insert to hold the axles therein and with upright portions at the ends of the pan which are apertured to snugly receive said projections, the body shell extending downwardly over the pan upright portions to securely lock them on the projections, and a fastening means for locking the shell to the pan and insert.

BRIEF DESCRIPTION OF THE DRAWINGS

In the drawings:

FIG. 3 is a side elevation of the vehicle in fully assembled condition.

FIG. 4 is a bottom plan view of the vehicle in assembled condition.

FIG. 5 is a longitudinal vertical section through the vehicle taken along line 5—5 of FIG. 4.

DESCRIPTION OF THE PREFERRED EMBODIMENT

Figure 1:
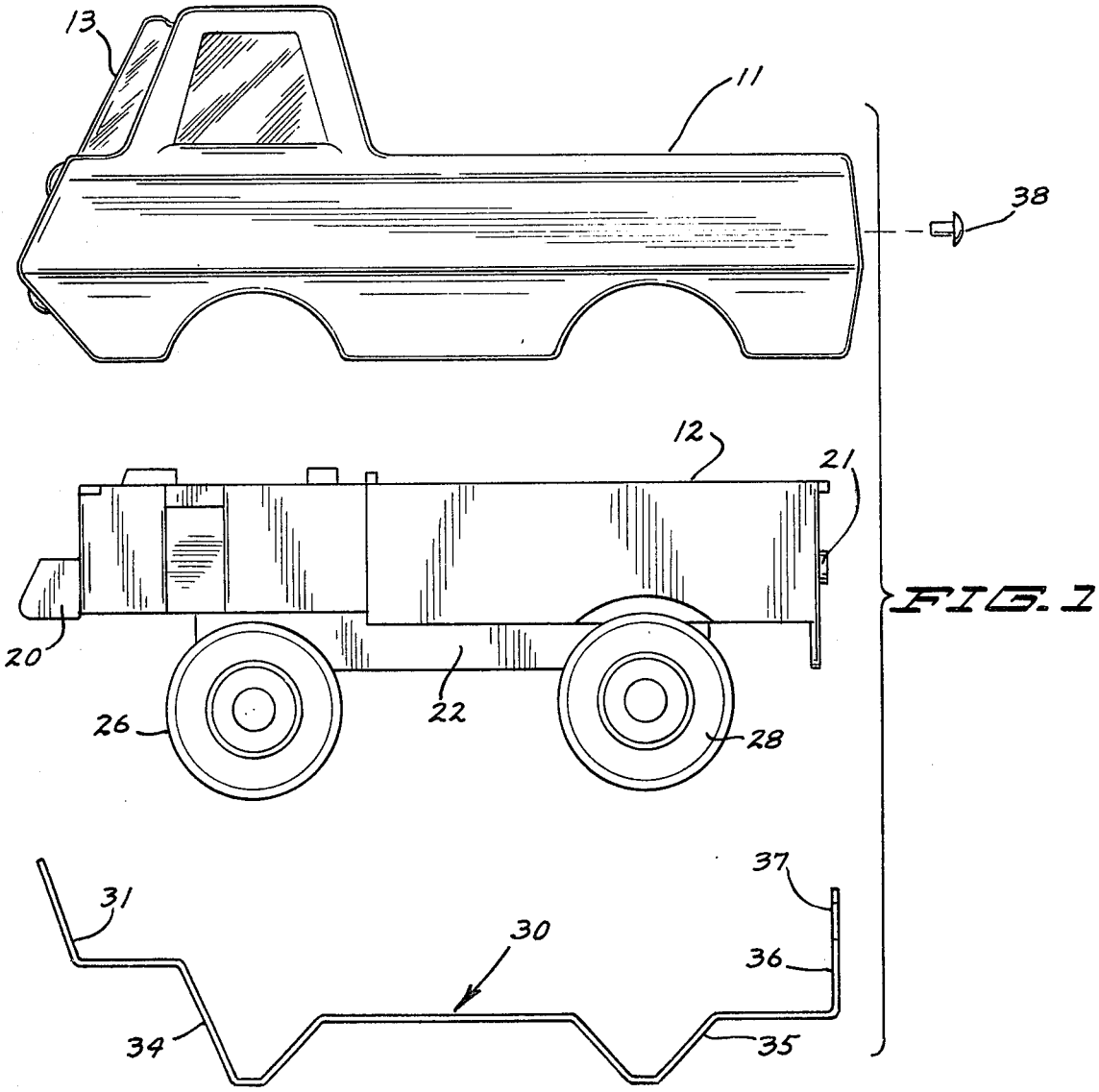
FIG. 1 is a side elevation of the toy vehicle showing the parts in exploded pre-assembled positions.

Referring now more particularly to the drawings reference numerals will be used to denote like parts and structural features in the different views. The miniature toy vehicle is denoted generally by the numeral 10. The vehicle has a body comprised of an outer metal shell 11 and a body insert 12 preferably formed of a plastic material and designed to simulate the inner cab and truck box portions of the vehicle, as can best be understood by referring to FIG. 5. The front cab portion of the vehicle may contain a passenger compartment bubble 13 of transparent plastic material.

The body shell 11 has a front end wall 14 which is provided with a wide rectangular grille opening 15 extending transversely thereacross. At its rear end the shell has a rear wall formed of partially overlapping sections 16 and 17 provided respectively with aligned apertures 18 and 19.

The insert 12 has a projection 20 at its front end designed as a vehicle grille and of a size adapted to be inserted into and fit snugly within the grille opening 15 in the shell 11. At its rear end the member 12 has a transversely centered rearwardly extending apertured boss 21 adapted to be axially aligned with apertures 18 and 19 when the vehicle is assembled. The insert has a pair of transversely spaced longitudinally extending flanges 22 extending along the bottom thereof having transversely aligned downwardly opening front and rear slots respectively denoted at 24 and 25. These are snap-in type slots which are slightly wider at their upper closed ends to receive the vehicle axles. The portions of flanges 22 containing slots 24 and 25 extend downwardly below the central portion of the flanges as shown in FIG. 5.

A pair of vehicle front wheels 26 are mounted at the ends of a front axle 27 which is press fit into the upper ends of slots 24. A pair of rear wheels 28 are similarly mounted on axle 29 which is press fit into slots 25.

A pan denoted generally by the numeral 30 formed of a somewhat resilient sheet material extends along the underside of the body insert 12. This pan has a longitudinal configuration such as shown in the bottom view in FIG. 1 and in FIG. 5 and a shape in plan as best shown in FIG. 4. At its forward end the pan has a hook plate 31 provided with a wide rectangular grille opening 32 which is comparable in size and shape to opening 15 and adapted to snugly receive the projection 20 on the front end of insert 12. Rearwardly of the plate 31 the pan 30 has a narrowed V-shaped portion 34 which extends between the wheels 26 and flanges 22 and under axle 27 in close proximity thereto. The pan then extends rearwardly along the underside of the central portions of flanges 22 with another narrowed V-shaped portion 35 extending between the wheels 28 and under the axle 29 in close proximity thereto. At its rear end the pan 30 has an upwardly extending flange 36 which is provided with a transversely centered aperture 37 adapted to receive boss 21.

A rivet 38 serves as a fastener to extend through apertures 18, 19 and the aperture in boss 21 to secure the body shell sections 16 and 17 to the insert 12 and lock the flange 36 therebetween.

In assembling the toy 10, the axles 27 and 29 with the wheels 26 and 28 mounted thereon are snapped into the slots 24 and 25 of insert 12. The pan 30 is then attached to the insert by hooking the front plate 31 onto the projection 20 with the projection extending through opening 32. Flange 36 is moved upwardly over the rear end of the insert until the boss 21 seats in the aperture 37. The spring tension within pan 30 yieldably retains it in this position on the insert.

Figure 2:
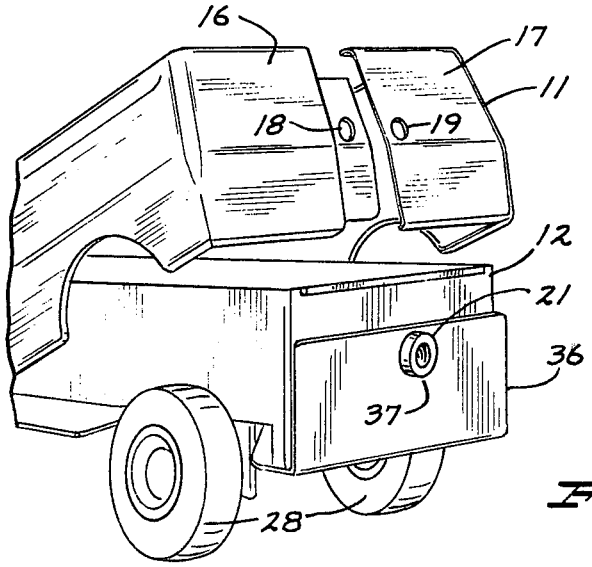
FIG. 2 is a left rear perspective of the rear portion of the vehicle during assembly.

The body insert 12 with the pan 30 attached thereto is then inserted upwardly and forwardly into the shell 11 so that projection 20 fits within the grille opening 14. At this point the components 11 and 12 are in the relative position shown in FIG. 2. The rear portion of shell 11 with sections 16 and 17 spread slightly apart as shown is then lowered onto the rear portion of the insert. Sections 16 and 17 are then closed into partially overlapping positions bringing the apertures 18 and 19 into axial alignment with each other and the boss 21 and rivet 38 insert forwardly therethrough and peened to securely lock all of the components in assembled condition.

Pan 30 being irremovably locked on the insert provides a smooth bottom surface on the toy and prohibits removal of the wheel and axle assemblies.

Having now therefore fully illustrated and described the invention, what I claim to be new and desire to protect by United States Letters Patent is:

1. In a miniature toy vehicle, a. a vehicle body shell having a front wall with a grille opening and a rear wall with an aperture therein, b. a body insert having a projection at one end fitting in the grille opening, an aperture at its other end and slots on its underside for receiving a wheel axle, c. a wheel carrying axle disposed in said slots, d. a pan extending along the underside of the insert to prohibit removal of the axle from the insert slots and having a hook means at one end engaging over the projection and an aperture at its other end aligned with the apertures in the insert and shell when the members are assembled, and e. a fastener extending through said apertures to lock the shell, insert and pan together.

2. The subject matter of claim 1 wherein the insert has an annular boss surrounding the said aperture therein, and the aperture in the pan adapted to receive the boss.

3. The subject matter of claim 1 wherein the projection on the insert comprises a forwardly protruding portion of the vehicle grille and the hook means on the pan comprises a plate with an opening therein receiving said grille portion.

* * * * *